US007059289B2

(12) United States Patent
Cunningham et al.

(10) Patent No.: US 7,059,289 B2
(45) Date of Patent: Jun. 13, 2006

(54) AIR INTAKE MANIFOLD WITH COMPOSITE FLANGE AND METHOD

(75) Inventors: Robert R. Cunningham, Clawson, MI (US); Ulhas Grover, Northville, MI (US)

(73) Assignee: Lanxess Corporation, Pittsburgh, PA (US)

( * ) Notice: Subject to any disclaimer, the term of this patent is extended or adjusted under 35 U.S.C. 154(b) by 0 days.

(21) Appl. No.: 10/913,913

(22) Filed: Aug. 6, 2004

(65) Prior Publication Data

US 2006/0027203 A1 Feb. 9, 2006

(51) Int. Cl.
*F02M 35/10* (2006.01)

(52) U.S. Cl. ..... 123/184.47; 123/184.21; 123/184.61; 123/568.17

(58) Field of Classification Search ..... 123/184.21–184.61, 568.17
See application file for complete search history.

(56) References Cited

U.S. PATENT DOCUMENTS 4,776,313 A * 10/1988 Freismuth et al. ..... 123/470
5,190,802 A 3/1993 Pilato ..... 426/111
5,253,616 A * 10/1993 Voss ..... 123/184.47
5,636,605 A * 6/1997 Nomizo et al. ..... 123/184.61
5,699,835 A * 12/1997 Nakagawa et al. ..... 138/141
6,467,449 B1 * 10/2002 Brassell et al. ..... 123/184.61
6,857,409 B1 * 2/2005 Ito et al. ..... 123/184.42

* cited by examiner

*Primary Examiner*—Willis R. Wolfe
*Assistant Examiner*—Johnny H. Hoang
(74) *Attorney, Agent, or Firm*—Jill Denesvich

(57) ABSTRACT

The air intake manifold assembly includes a manifold with a plurality of air intake ports for fluid communication with a plurality of engine cylinders, respectively, and a composite flange assembly associated with the air intake ports. The composite flange assembly is adapted to connect the air intake ports with the engine cylinders. The composite flange assembly includes a polymeric flange and a metal reinforcement member joined to the polymeric flange. The metal reinforcement member defines one or more openings and the polymeric flange is joined with the metal reinforcement member, such that at least a portion of the polymeric flange extends through the openings and forms one or more annular surfaces for contacting the engine cylinders. The metal reinforcement member may be integrally molded with the polymeric flange, or joined to the polymeric flange by interference engagement therewith. The polymeric flange may partially encapsulate the metal reinforcement member.

30 Claims, 7 Drawing Sheets

AIR INTAKE MANIFOLD WITH COMPOSITE FLANGE AND METHOD

BACKGROUND OF THE INVENTION

1. Field of the Invention

The present invention relates in general to vehicle engines and, in particular, to an air intake manifold and a composite flange assembly or structure for use with the air intake manifold and vehicle engines, generally.

2. Description of Related Art

An air intake manifold assembly of a multi-cylinder engine typically includes a plurality of branched air passageways or ducts. Each of the air passageways defines a generally tubular-shaped runner having an air intake port and an opposing air inlet port. The air intake port of the runner is connected to an associated plenum that supplies atmospheric, turbo, or supercharged air to the runner air intake port. The air inlet port is connected to a flange that is connected to an associated air inlet port of each cylinder of the engine to supply the air from the runner to each cylinder. Conventional air intake manifold assemblies are typically constructed of cast iron, magnesium, aluminum, and plastic.

A typical aluminum air intake manifold assembly is produced by conventional casting processes. These manifolds typically include a plurality of tubes arranged having one end connected with the outlet holes of an air intake plenum, and opposing ends connected with the associated holes of a flange member which is adapted for mounting to a cylinder head of an engine. The tubes may be U-shaped to fit conveniently in the allowed space and as such the manifold cannot typically be cast in one piece but rather must be cast in multiple sections, for example in two sections. One section includes a length of the tubing cast integrally with the plenum and the other section includes the remaining length of the tubing cast integrally with the flange member. This manifold configuration allows adequate access to the mounting features of the manifold. The halves must then be joined together with bolts and a gasket or other suitable hardware to complete the manifold, further adding to the cost and complexity of the manifold. In like manner, the lack of access to some mounting fasteners may require the manifold to be made of a very stiff material to allow the elimination of the occluded fasteners.

A typical plastic manifold maybe formed as one piece or in multiple pieces. Plastic manifolds may be produced using injection molding or blow molding processes. Subsequent secondary operations then create a hollow structure for fluid communications of air into the inlet ports of the cylinder head. A typical plastic multi-piece manifold assembly may include an upper half shell and a lower half shell which are joined together by a welding process to create a hollow structure. In some instances, the plastic multi-piece manifold assembly includes one or more inner shell pieces that are disposed within the upper and/or lower half shells. The inner shell may be lower partial inserts that are secured to the lower half shell, upper partial inserts which are secured to the upper half shell, or both lower and upper partial inserts which are secured to the respective lower and upper half shells. The inserts are typically joined to the associated half shell by a conventional heat staking process or welding process. In some instances, a plurality of individual tubes are disposed within the upper and lower half shells and joined thereto by a conventional heat staking or welding process. In both types of constructions, the inserts or the inserts in cooperation with upper or lower half shells define a corresponding number of runner paths through which air is supplied to the associated cylinder head of the engine.

The conventional metal components typically used within air intake manifold assemblies are heavier and costlier than desirable. Consequently, with requirements for reduced weight and improved performance of vehicle engines, a need exists to form more engine components from plastic and/or composite materials. Also, with an emphasis on cost and reliability, it is desirable to reduce the number of parts needed to form an assembly and to reduce the service costs by minimizing the time and tools needed for servicing. While plastic and composite materials are in use for some vehicle components, plastics and composites are generally not as strong (i.e., stiff) as conventional metals. Generally, conventional metal components have no difficulty achieving desired strength (i.e., stiffness) requirements, but plastics and composites, in general, do not traditionally perform as well as conventional metal components for sealing and mounting functions.

Thus, it is desirable to provide an air intake manifold assembly that improves weight, cost, and complexity concerns as compared with conventional metal assemblies, but performs equally as well in the air flow metering function and local stiffness for mounting and sealing of the conventional assemblies.

SUMMARY OF THE INVENTION

The present invention is an air intake manifold assembly and, further, a composite flange assembly that may be associated with the air intake manifold assembly. In one embodiment, the composite flange assembly may be associated with a manifold for connecting the manifold to a plurality of engine cylinders of a vehicle engine. Generally, the air intake manifold assembly includes a manifold and a composite flange assembly associated with the manifold. The manifold includes a plurality of air intake ports for fluid communication with a plurality of engine cylinders of a vehicle engine. The composite flange assembly is associated with the air intake ports and is adapted to connect the air intake ports with the engine cylinders. The composite flange assembly generally includes a polymeric flange associated with the air intake ports and a metal reinforcement member joined to the polymeric flange.

The metal reinforcement member may define a plurality of openings generally corresponding to the air intake ports. The plurality of openings may be defined by respective perimetrically-extending raised lips on the metal reinforcement member. The polymeric flange may be joined to the metal reinforcement member, such that at least a portion of the polymeric flange extends through the openings. The portion of the polymeric flange extending through the openings may at least partially encapsulate the raised lips. The portion of the polymeric flange extending through the openings may further form a surface, for example in the form of a ring, for contacting or engaging the engine cylinders. Additionally, the portion of the polymeric flange extending through the openings may define a groove for cooperating with a seal associated with the engine cylinders.

The metal reinforcement member may be integrally molded with the polymeric flange. The polymeric flange may at least partially encapsulate the metal reinforcement member.

The metal reinforcement member may further include at least one sidewall, and the polymeric flange may at least partially encapsulate the at least one sidewall. The at least one sidewall may terminate in a lip, and the polymeric flange may partially or fully encapsulate the lip.

The metal reinforcement member may alternatively be joined to the polymeric flange by interference engagement with the polymeric flange. The polymeric flange may include reinforcement ribs extending between opposing sides of the polymeric flange. The metal reinforcement member may define at least one opening or hole for accepting a fastener used to secure the flange assembly to the engine cylinders.

Additionally, as indicated, the present invention is a composite flange assembly that may be adapted for use as part of an air intake manifold assembly. However, the composite flange assembly may be an independent component or structure that is generally adapted to provide sealing engagement with or between any engine component(s) associated with a vehicle engine where such a sealing engagement or contact is required or desirable. Thus, the composite flange assembly of the present invention is not limited only to use with the air intake manifold assembly discussed previously. The composite flange assembly generally includes a polymeric flange and a metal reinforcement member joined to the polymeric flange. The metal reinforcement member defines at least one opening and the polymeric flange is joined with the metal reinforcement member, such that at least a portion of the polymeric flange extends through the at least one opening and forms a surface, for example in the form of a ring, for contacting or engaging the engine component(s).

The at least one opening may be defined by a perimetrically-extending raised lip on the metal reinforcement member. The portion of the polymeric flange extending through the at least one opening may at least partially encapsulate the raised lip. The portion of the polymeric flange extending through the at least one opening may further define a groove for associating the flange assembly with the engine component.

Additionally, the metal reinforcement member may be integrally molded with the polymeric flange in the composite flange assembly. The polymeric flange may at least partially encapsulate the metal reinforcement member.

The metal reinforcement member may include at least one sidewall, and the polymeric flange may at least partially encapsulate the at least one sidewall. The at least one sidewall may terminate in a lip, and the polymeric flange of the composite flange assembly may partially or fully encapsulate the lip.

The metal reinforcement member may alternatively be joined to the polymeric flange by interference engagement with the polymeric flange in the composite flange assembly. The polymeric flange may include reinforcement ribs extending between opposing sides of the polymeric flange. The metal reinforcement member of the composite flange assembly may define at least one opening or hole for accepting a fastener used to secure the flange assembly to the engine component.

Additionally, the present invention is a method of producing the composite flange assembly adapted to provide sealing engagement or contact with an engine component or between engine components. The method generally includes forming the polymeric flange adapted for connection, contact, or association with the engine component, and joining the metal reinforcement member with the polymeric flange to reinforce the polymeric flange. The metal reinforcement member generally defines at least one opening and the metal reinforcement member is joined with the polymeric flange, such that at least a portion of the polymeric flange extends through the at least one opening and forms a surface, for example in the form of a ring, for contacting or engaging the engine component.

The metal reinforcement member may be joined to the polymeric flange by injection molding the metal reinforcement member with the polymeric flange. The metal reinforcement member may be injection-molded with the polymeric flange such that the polymeric flange at least partially encapsulates the metal reinforcement member.

The at least one opening in the metal reinforcement member may be defined by a perimetrically-extending raised lip on the metal reinforcement member, and the portion of the polymeric flange extending through the at least one opening may at least partially encapsulate the raised lip. The metal reinforcement member may further include at least one sidewall terminating in a lip, and the polymeric flange may at least partially encapsulate the lip. The metal reinforcement member may be joined to the polymeric flange by interference engagement with the polymeric flange.

The method may further include at least partially melting the polymeric flange and joining the metal reinforcement member to the polymeric flange in the at least partially plasticized state of the polymeric flange.

Other details and advantages of the present invention will become apparent when reading the following detailed description of the preferred embodiments, in conjunction with the accompanying drawings.

DESCRIPTION OF THE PREFERRED EMBODIMENTS

Figure 1:
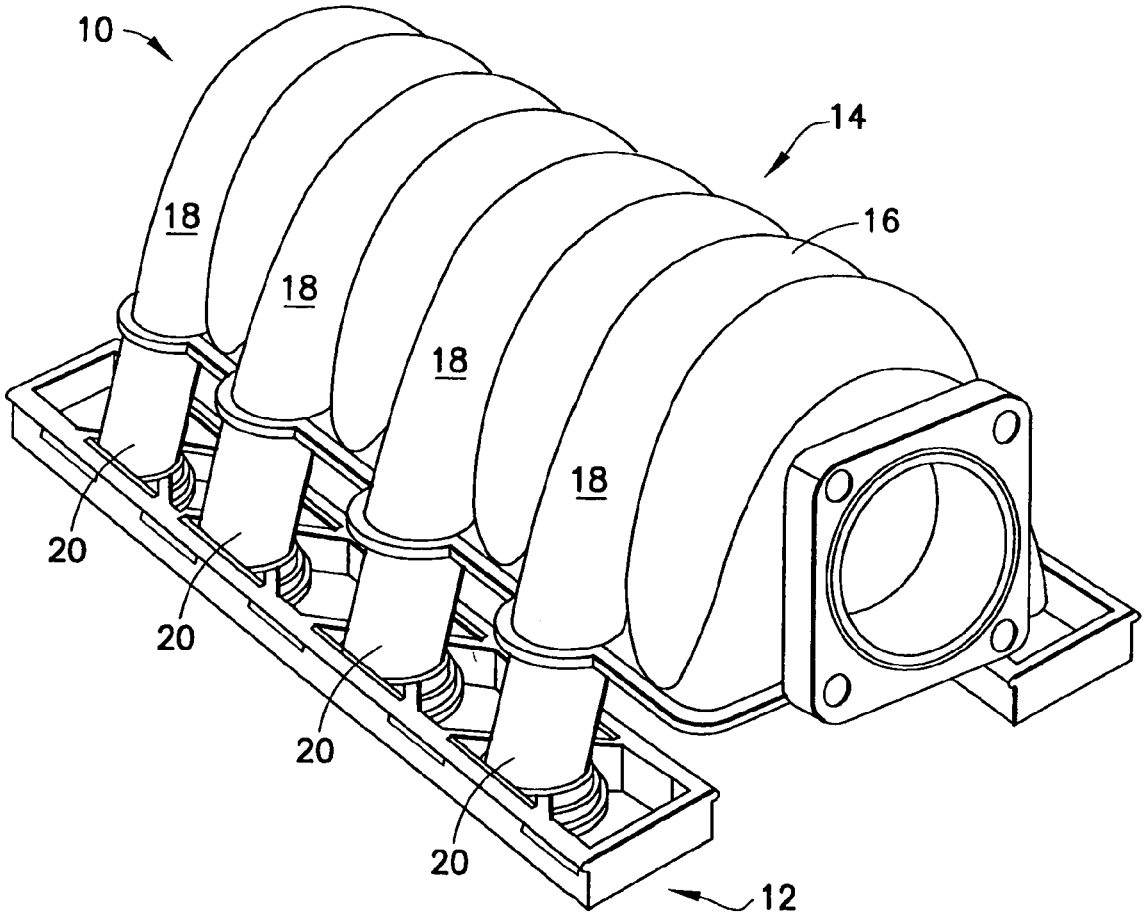
FIG. 1 is a perspective view of an air intake manifold assembly in accordance with the present invention.
Figure 2:
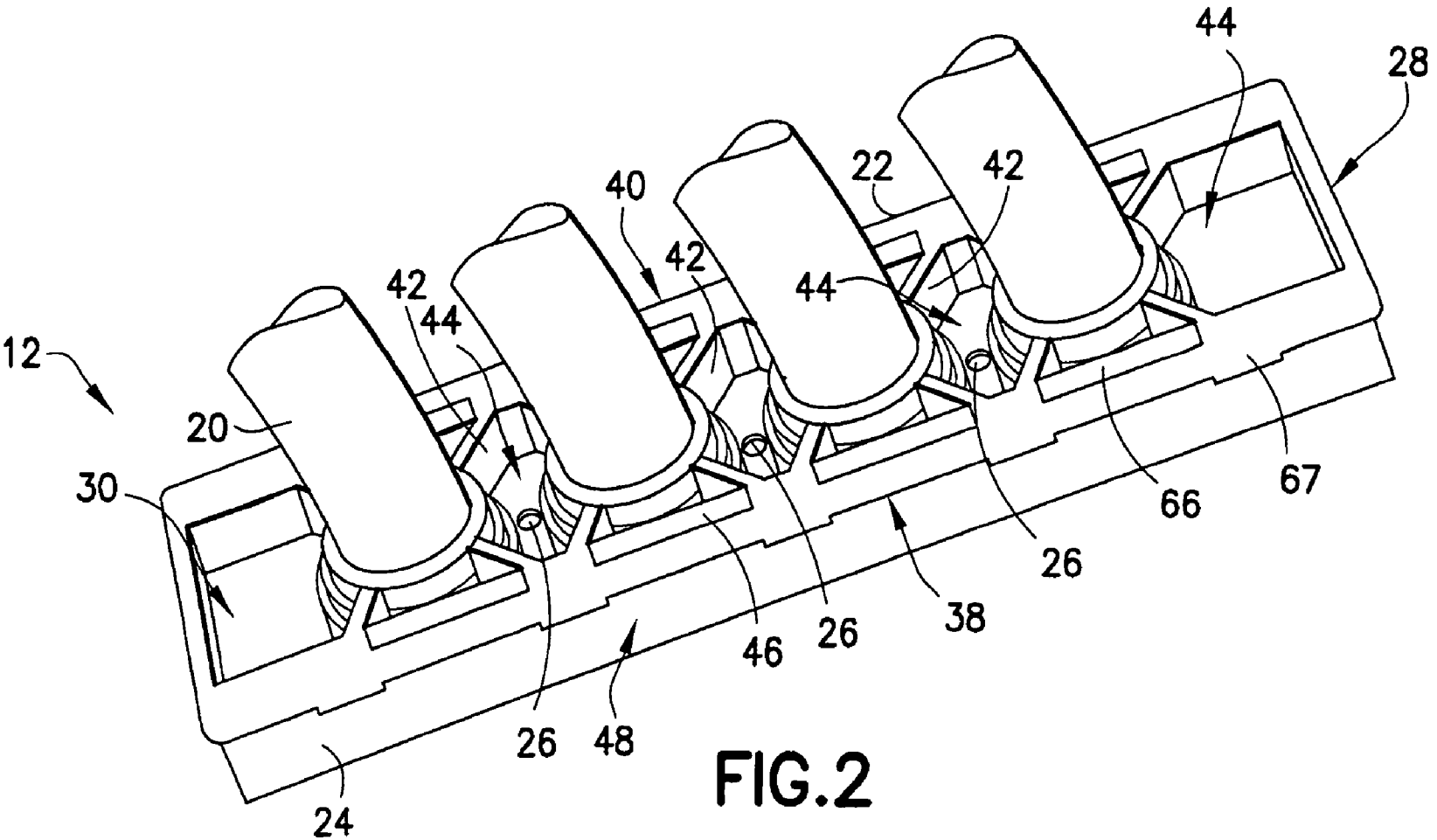
FIG. 2 is a perspective view of a portion of the air intake manifold assembly of FIG. 1, including a composite flange assembly also in accordance with the present invention.

Referring to the drawings in which like reference characters refer to like parts throughout the several views thereof, FIG. 1 illustrates generally an air intake manifold assembly 10 in accordance with the present invention and its related features. The present invention is generally described in terms of the air intake manifold assembly 10 and encompasses such an assembly, as well as in terms of a composite flange assembly or structure 12 adapted for use in the air intake manifold assembly 10 and for vehicle engines, generally.

With reference to FIGS. 1–7, the air intake manifold assembly 10 (hereinafter "manifold assembly 10") generally includes a manifold 14. The manifold 14 is a generally hollow structure comprised of a hollow body 16. The hollow body 16 includes or defines a plurality of passages 18 in fluid communication with a plenum (not shown). The number of passages 18 generally corresponds to the number of engine cylinders (not shown) with which the manifold assembly 10 is to be associated. The manifold 14 may be a multi-piece structure formed, for example, by an upper shell and a lower shell that are joined together by a welding process to create the hollow structure. Inserts may be provided within the hollow body 16 of the manifold 14 to form or define the passages 18. As will be appreciated by those skilled in the art, the hollow body 16 may be formed by any number of shells and inserts in accordance with techniques known in the art. Alternatively, the hollow body 16 may be a single-component structure formed by a lost core process, injection molding process, or blow-molding process. The hollow body 16, while preferably made of polymeric material, may be made of metal such as aluminum, magnesium, and like metals.

The hollow body 16 of the manifold 14 further includes or defines a plurality of air intake ports 20, which are used to place the passages 18 in fluid communication with the respective engine cylinders. The intake ports 20 generally depend from the hollow body 16 for operatively associating the manifold assembly 10 with the engine cylinders disposed in the cylinder head of a vehicle engine.

The manifold assembly 10 is generally adapted for connection to the cylinder head (not shown) of a vehicle engine by mechanical fasteners associated with the composite flange assembly 12. The composite flange assembly 12 (hereinafter "flange assembly 12") is a composite structure formed or comprised by a polymeric flange 22 and a metal reinforcement member 24. The metal reinforcement member 24 defines holes 26 for accepting fasteners (i.e., bolts) used to secure the manifold assembly 10 to the cylinder head of the engine. Alternatively, the polymeric flange 22 and metal reinforcement member 24 may cooperatively define the holes 26. In either configuration, only a limited number of fasteners are needed to operatively associate the manifold assembly 10 with the vehicle engine. The holes 26 may be located at any suitable location along the length of the reinforcement member 24, between opposing ends 28, 30 of the metal reinforcement member 24

The polymeric flange 22 and metal reinforcement member 24 are joined together preferably by integrally molding the metal reinforcement member 24 with the polymeric flange 22, preferably during an injection molding procedure. Alternatively, the metal reinforcement member 24 may be press-fitted to the polymeric flange 22 such that the metal reinforcement member 24 is secured to the polymeric flange 22 by interference engagement between the metal reinforcement member 24 and the polymeric flange 22. Additionally, the metal reinforcement member 24 may be joined to the polymeric flange 22 by applying heat to selected portions or areas of the polymeric flange 22 to cause these portions or areas to become plasticized (i.e., partially melted). Once selected portions or areas of the polymeric flange 22 are in a plasticized state, the metal reinforcement member 24 may be joined to the polymeric flange 22 by press-fitting or applying pressure to the metal reinforcement member 24 to at least partially integrally join the metal reinforcement member 24 to the polymeric flange 22.

The flange assembly 12 may be integrally formed as an end flange for the air intake ports 20, connecting the adjacent passages 18 disposed on opposite sides of the hollow body 16 together. Alternatively, the flange assembly 12 may be a separate structure attached to the air intake ports 20. In either configuration, the manifold assembly 10 generally includes one or two flange assemblies 12 typically disposed on opposing sides of the hollow body 16.

As shown in FIG. 1, the illustrated manifold assembly 10 is adapted for association with an eight-cylinder, V-configuration vehicle engine as an example, and includes four passages 18 on each side of the hollow body 16 for associating the manifold assembly 10 with the eight-cylinders of the engine. The two flange assemblies 12 generally connect the four passages 18 provided on each side of the hollow body 16 with the cylinders of the engine, as will be appreciated by those skilled in the art. The polymeric flanges 22 may be integrally formed with the air intake ports 20 and partially define the air intake ports 22.

The polymeric flange 22 is a generally elongated structure having opposing sides 38,40. The polymeric flange 22 may be formed with a perimetrically-extending sidewall that forms the opposing sides 38,40. However, it is not necessary for such a sidewall to extend completely around the polymeric flange 22 in The flange assembly 12. The opposing sides 38,40 are preferably interconnected by reinforcing ribs 42 for enhancing the strength of the polymeric flange 22. The reinforcing ribs 42 may extend the entire depth of The Interior of the polymeric flange 22 and define Internal spaces 44 within the polymeric flange 22. A suitable structure for the internal reinforcing ribs 42 is disclosed in U.S. Pat. No. 5,190,8003 to Goldbach et al., the disclosure of which is incorporated by reference herein in its entirety. As indicated previously, the polymeric flange 22 is preferably injection molded with the metal reinforcement member 24 in place within the injection mold so that the polymeric flange 22 and the metal reinforcement plate 24 are integrally joined or formed as a composite structure.

Figure 3:
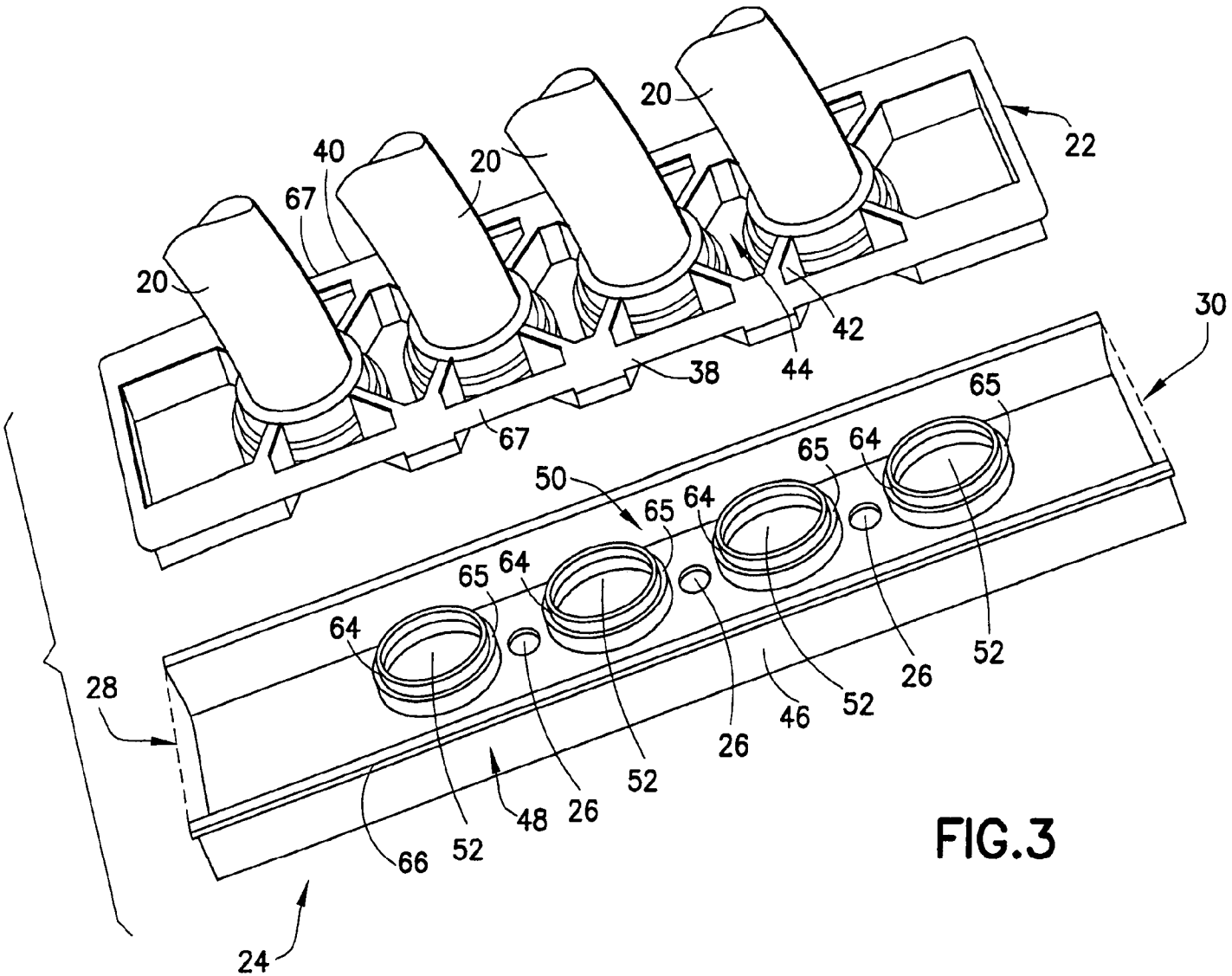
FIG. 3 is an exploded perspective view of the portion of the air intake manifold assembly shown in FIG. 2.
Figure 4:
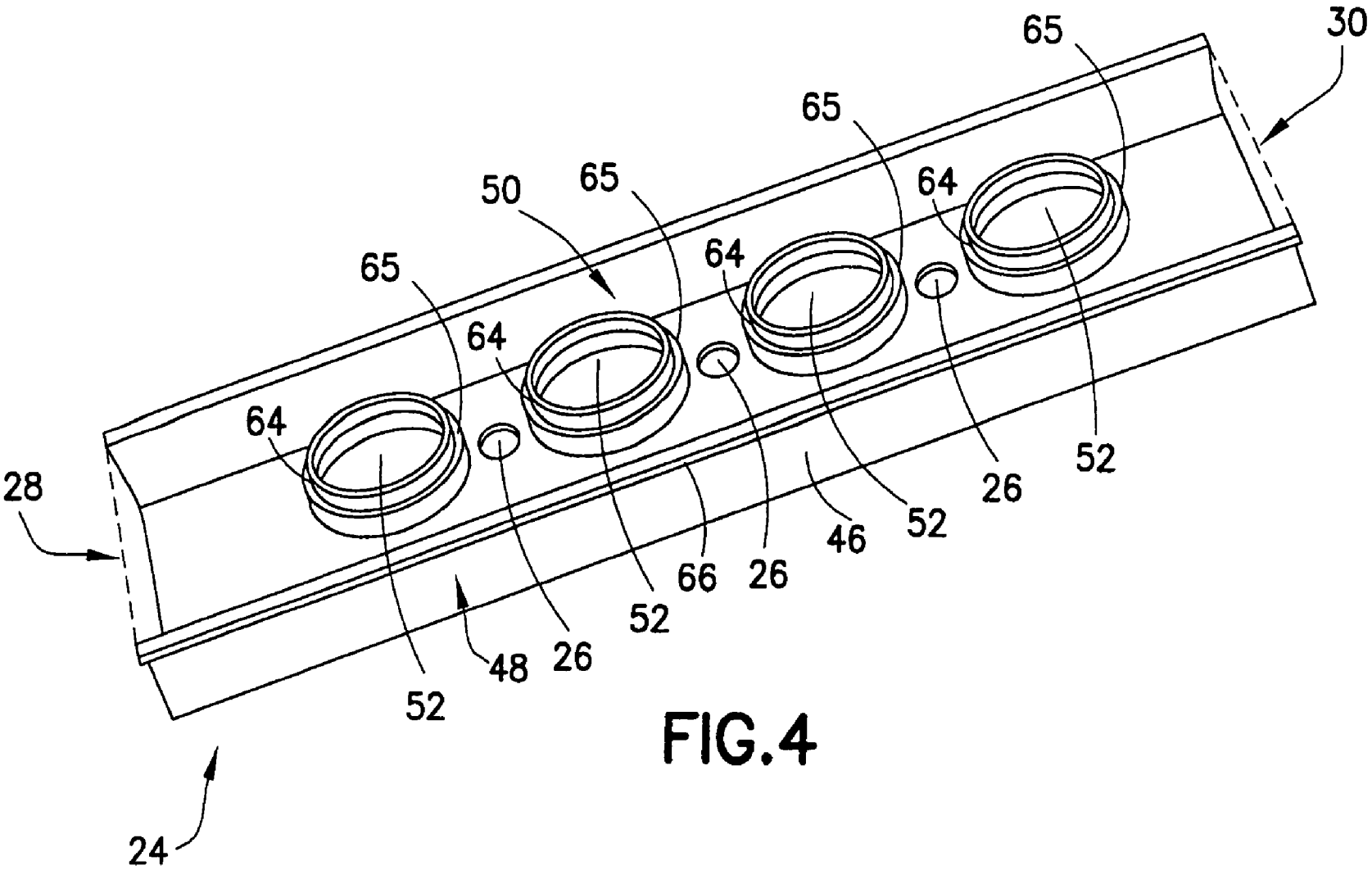
FIG. 4 is a perspective view of a metal reinforcement member of the composite flange assembly shown in FIG. 2.

The metal reinforcement member 24 is preferably a stamped metal member, for example a stamped steel member. The metal reinforcement member 24 is generally formed to engage or cooperate with the polymeric flange 22 and preferably includes a single circumferential or perimetrically-extending sidewall 46 with opposing sides 48, 50. However, as shown in FIGS. 3 and 4 discussed herein, it is not necessary for the sidewall 46 to extend completely around the metal reinforcement member 24 in the flange assembly 12. As shown in FIGS. 3 and 4, the metal reinforcement member 24 may include two opposing sidewalls 48, 50 and two open ends connected by the polymeric flange 22. The preferred embodiment of the sidewall 46 has two closed ends, which is represented by dotted lines in FIGS. 3 and 4. The metal reinforcement member 24 defines a plurality of openings 52 that generally correspond to the air intake ports 20, which generally correspond to the engine cylinders of the engine.

Figure 5:
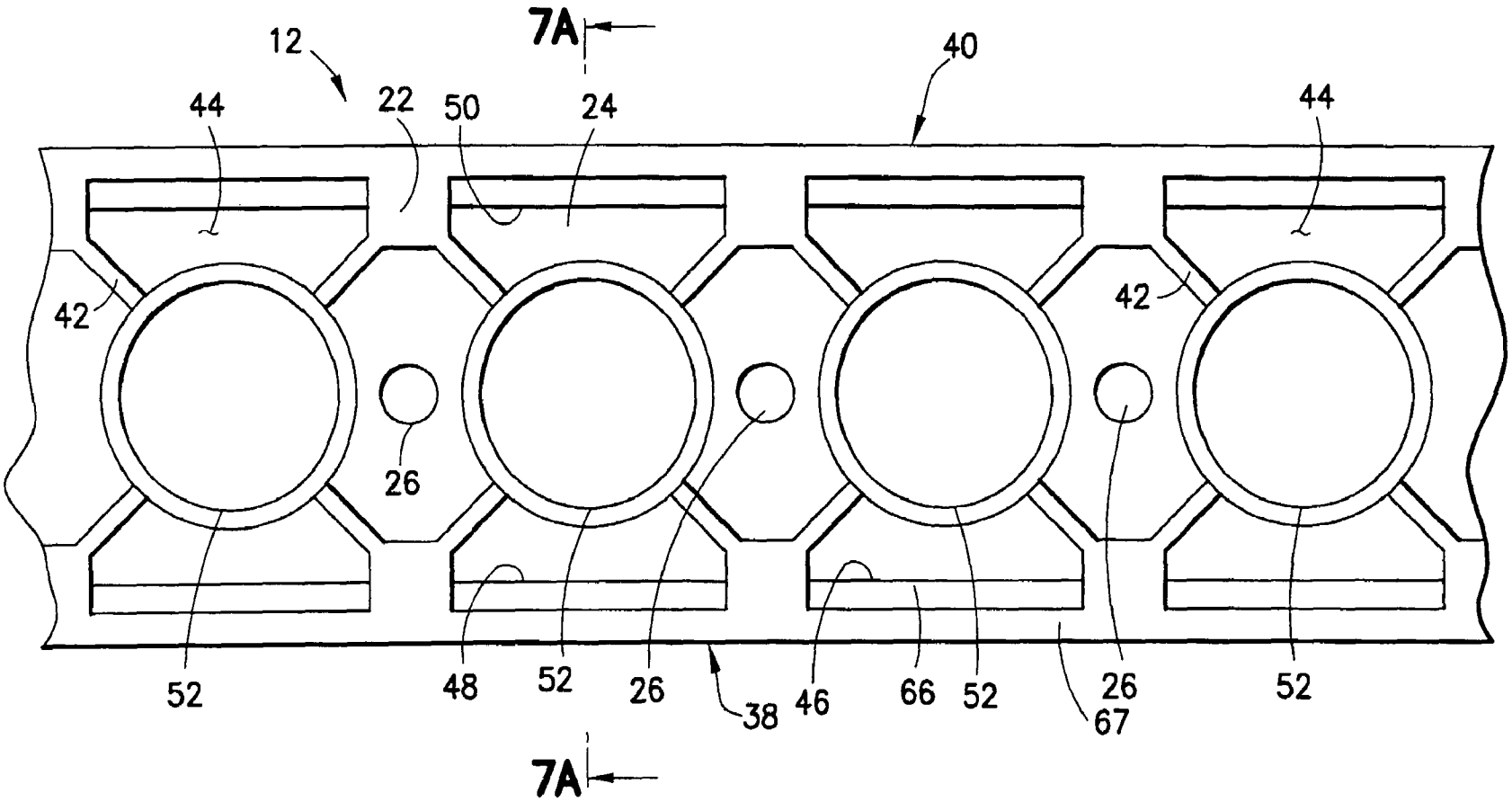
FIG. 5 is a top view of the composite flange assembly of FIG. 2, showing the composite flange assembly independent of the air intake manifold assembly.
Figure 6:
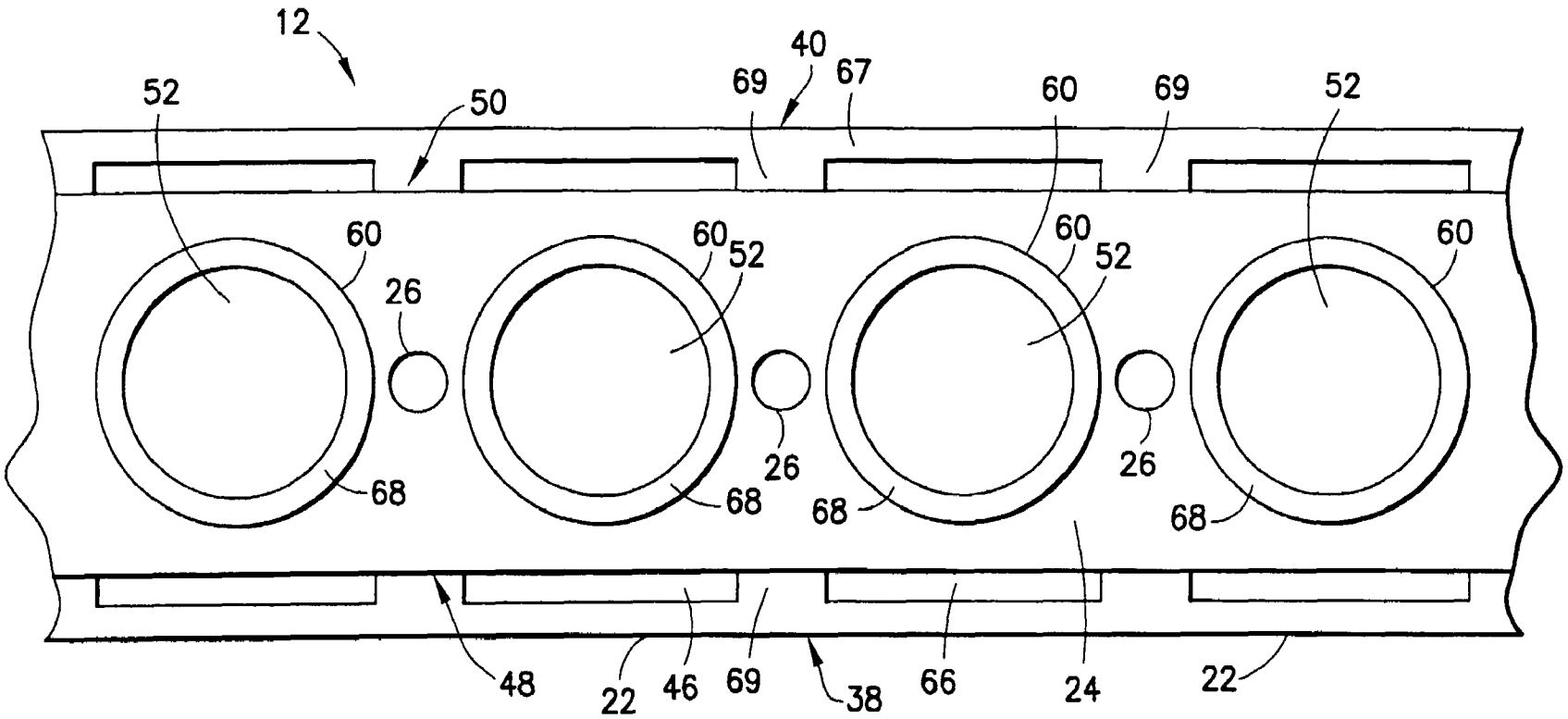
FIG. 6 is a bottom view of the composite flange assembly shown in FIG. 5.
Figure 7A:
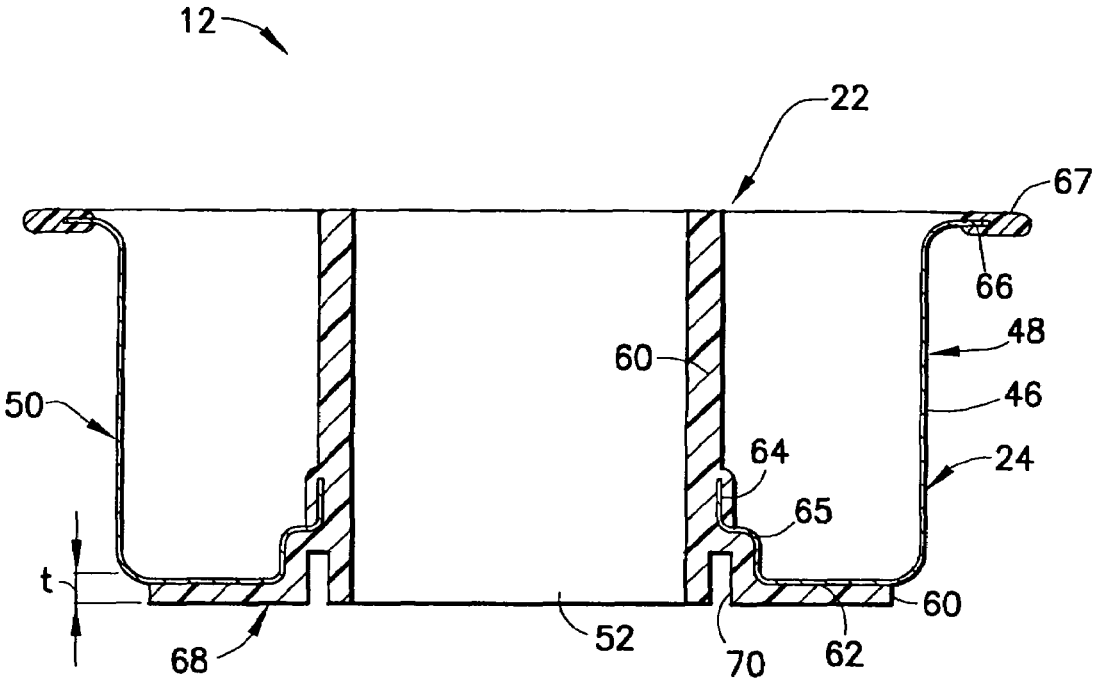
FIG. 7A is a cross-sectional view taken along line 7A—7A in FIG. 5.
Figure 7B:
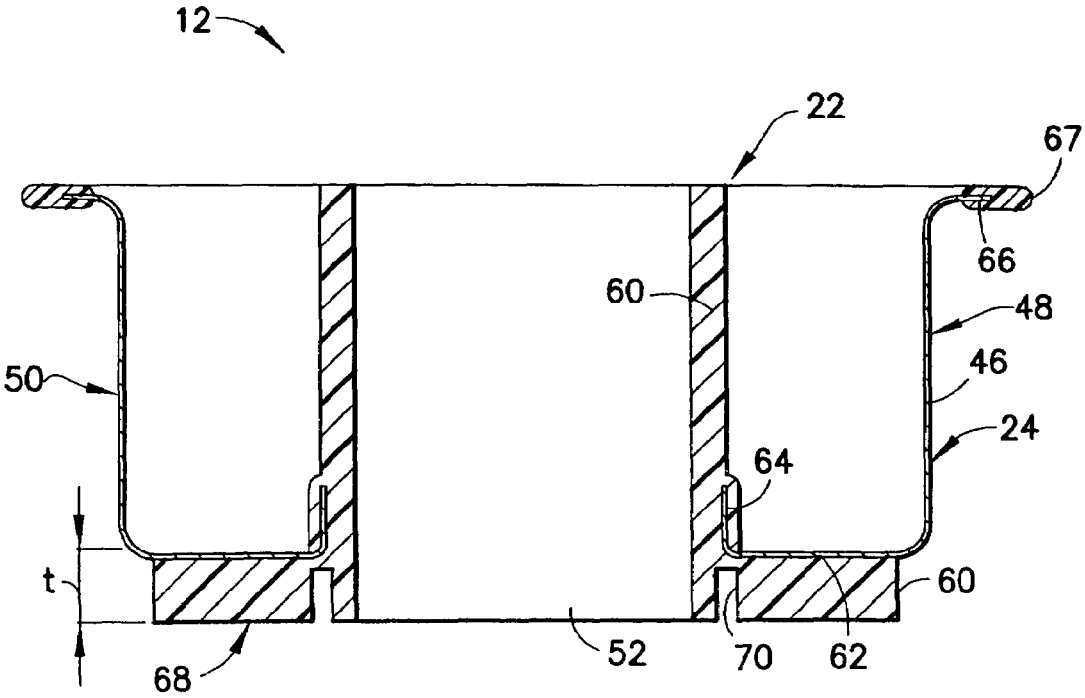
FIG. 7B is a cross-sectional view showing a variation of the composite flange assembly shown in FIG. 7A.

FIGS. 5 and 6 show the flange assembly 12 of the present invention independent of the manifold assembly 10, while FIGS. 7A and 7B illustrate the composite structure of the flange assembly 12. The polymeric flange 22 and the reinforcement member 24 are preferably joined such that the polymeric flange 22 partially encapsulates or encompasses, at least in part, the metal reinforcement member 24. In particular, the polymeric flange 22 is joined to the metal reinforcement member 24 such that a lining portion 60 of the polymeric flange 22 extends through the openings 52 in the metal reinforcement member 24 to partially encompass a bottom wall 62 of the metal reinforcement member 24, preferably in the immediate vicinity of the openings 52 as shown in FIG. 6. The lining portion 60 preferably encompasses or encapsulates, at least partially, internal sidewalls or raised lips 64 of the metal reinforcement member 24 that form or define the respective openings 52. The encapsulated raised lips 64 generally improve the strength and stability of the connection between the polymeric flange 22 and the metal reinforcement member 24, as well as the sealing characteristics of the flange assembly 12 with the cylinder head of the engine. In FIG. 7A, the raised lip 64 is includes a shoulder for increased strength, whereas FIG. 7B includes a substantially vertical raised lip 64 without the shoulder 65.

Additionally, the polymeric flange 22 is joined to the metal reinforcement member 24 to encapsulate or encompass an outward-extending lip 66 of the perimetrical sidewall 46 of the metal reinforcement member 24, or opposing, outward-extending lips 66 if the metal reinforcement member 24 includes two opposing sidewalls 48, 50 rather than a single perimetrically-extending sidewall 46. As further shown in FIG. 7, the polymeric flange 22 is formed with a corresponding outward-extending lip or flange 67 that generally encapsulates or encompasses the lip(s) 66 of the metal reinforcement member 24. The outward extending lip 67 may include depending attachment tabs 69 on the underside of the lip 67 for further securing the connection between polymeric flange 22 and the metal reinforcement member 24.

As indicated previously, the lining portion 60 of the polymeric flange 22 forms or defines annular sealing surfaces or rings 68 associated with each of the openings 52 in the metal reinforcement member 24 for engaging the respective cylinders of the engine. The annular sealing surfaces or rings 68 are held in engagement with the engine cylinders by fasteners associated with the polymeric flange 22 and metal reinforcement member 24 and, specifically, the holes 26 defined in the metal reinforcement member 24. The lining portion 60 may have an increased depth or thickness t adjacent the bottom wall 62 of the reinforcement member 24, as shown in FIG. 7B. As shown in both FIGS. 7A and 7B, the lining portion 60 defines a groove or recess 70 for engaging a seal (not shown) associated with the cylinder head of the engine. The groove or recess 70 allows for easy adjustment of the seal for width and depth without costly production changes to alter the metal reinforcement member 24. The annular sealing surfaces 68 provide sealing engagement with the cylinder head of the engine and associate the air intake ports 20 with the engine cylinders via the openings 52.

The present invention is additionally a method of producing the manifold assembly 10 and the flange assembly 12. The method generally includes providing the polymeric flange 22, for example, by injection molding the polymeric flange 22. The polymeric flange 22 is generally adapted for association with the air intake ports 20 of the manifold 14. Next, the metal reinforcement member 24 is joined with the polymeric flange 22 to reinforce the polymeric flange 22. The metal reinforcement member 24 may be joined to the polymeric flange 22 by positioning the metal reinforcement member 24 within an injection mold prior to introducing molten plastic material into the injection mold that ultimately forms the polymeric flange 22. The molten plastic material generally encompasses or encapsulates, at least in part, the metal reinforcement member 24. Alternatively, the reinforcement member 24 may be press-fitted to the polymeric flange 22 after the polymeric flange 22 is injection molded. Heat may be applied to polymeric flange 22 prior to the press-fitting step or prior to applying pressure to join the metal reinforcement member 24 to the polymeric flange 22, so that the polymeric flange 22 is in at least a partial plastic state so that the metal reinforcement member 24 is at least partially integrally molded to the polymeric flange 22 at one or more discreet locations during the joining process.

As illustrated in FIGS. 7A and 7B, the metal reinforcement member 24 is preferably engaged with the polymeric flange 22 so that the polymeric flange 22 at least partially encapsulates the metal reinforcement member 24 and, in particular, has the lining portion 60 of the polymeric flange 22 extending through the openings 52 in the metal reinforcement member 24. As described previously, the lining portion 60 forms the annular sealing surfaces or rings 68 for engaging the cylinders of the engine.

The present invention was described in terms of an air intake manifold assembly and a composite flange assembly that may form part of the air intake manifold assembly. The flange assembly is a composite structure for securing the air intake manifold assembly to a vehicle engine, and is adapted to use a minimum number of fasteners to secure the air intake manifold assembly to the engine. The flange assembly provides annular sealing surfaces or rings for directly engaging the cylinders of the engine, allowing a fewer number of fasteners to be used to attach the air intake manifold assembly to the vehicle engine. While the composite flange assembly was described in combination with or as part of the air intake manifold assembly, the composite flange assembly is not intended to be limited to this specific application. The composite flange assembly may be an independent component or structure that is generally adapted to provide a continuous sealing engagement with or between any engine components associated with a vehicle engine where such a continuous sealing engagement or contact is required or desirable. Examples of such additional applications include, but are not limited to, throttle bodies and thermostat housings.

While the present invention is satisfied by embodiments in many different forms, there is shown in the drawings and described herein in detail, the preferred embodiments of the invention, with the understanding that the present disclosure is to be considered as exemplary of the principles of the invention and is not intended to limit the invention to the embodiments illustrated. Various other embodiments will be apparent to and readily made by those skilled in the art without departing from the scope and spirit of the invention. The scope of the invention will be measured by the appended claims and their equivalents.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An air intake manifold assembly, comprising:

a manifold comprising a plurality of air intake ports for fluid communication with a plurality of engine cylinders, respectively; and a composite flange assembly associated with the air intake ports and adapted to connect the air intake ports with the engine cylinders, the composite flange assembly comprising a polymeric flange and a metal reinforcement member joined to the polymeric flange, wherein the metal reinforcement member defines a plurality of openings generally corresponding to the air intake ports.

2. The air intake manifold assembly of claim 1, wherein the plurality of openings are defined by respective perimetrically-extending raised lips on the metal reinforcement member.

3. The air intake manifold assembly of claim 1, wherein the polymeric flange is joined to the metal reinforcement member, such that at least a portion of the polymeric flange extends through the openings.

4. The air intake manifold assembly of claim 3, wherein the plurality of openings are defined by respective perimetrically-extending raised lips on the metal reinforcement member, and the portion of the polymeric flange extending through the openings at least partially encapsulates the raised lips.

5. The air intake manifold assembly of claim 3, wherein the portion of the polymeric flange extending through the openings forms a surface for contacting the engine cylinders.

6. The air intake manifold assembly of claim 3, wherein the portion of the polymeric flange extending through the openings defines a groove for cooperating with a seal associated with the engine cylinders.

7. The air intake manifold assembly of claim 1, wherein the metal reinforcement member is integrally molded with the polymeric flange.

8. The air intake manifold assembly of claim 7, wherein the polymeric flange at least partially encapsulates the metal reinforcement member.

9. The air intake manifold assembly of claim 1, wherein the metal reinforcement member comprises at least one sidewall, and wherein the polymeric flange at least partially encapsulates the at least one sidewall.

10. The air intake manifold assembly of claim 9, wherein the at least one sidewall terminates in a lip, and wherein the polymeric flange encapsulates the lip.

11. The air intake manifold assembly of claim 1, wherein the metal reinforcement member is joined to the polymeric flange by interference engagement with the polymeric flange.

12. The air intake manifold assembly of claim 1, wherein the polymeric flange comprises reinforcement ribs extending between opposing sides of the polymeric flange.

13. The air intake manifold assembly of claim 1, wherein the metal reinforcement member defines at least one hole for accepting a fastener used to secure the flange assembly to the engine cylinders.

14. A composite flange assembly for providing sealing engagement with an engine component, comprising:

a polymeric flange; and a metal reinforcement member joined to the polymeric flange, the metal reinforcement member defining at least one opening and the polymeric flange joined with the metal reinforcement member, such that at least a portion of the polymeric flange extends through the at least one opening and forms a surface for contacting the engine component.

15. The composite flange assembly of claim 14, wherein the at least one opening is defined by a perimetrically-extending raised lip on the metal reinforcement member.

16. The composite flange assembly of claim 15, wherein the portion of the polymeric flange extending through the at least one opening at least partially encapsulates the raised lip.

17. The composite flange assembly of claim 14, wherein the portion of the polymeric flange extending through the at least one opening defines a groove for associating the flange assembly with the engine component.

18. The composite flange assembly of claim 14, wherein the metal reinforcement member is integrally molded with the polymeric flange.

19. The composite flange assembly of claim 18, wherein the polymeric flange at least partially encapsulates the metal reinforcement member.

20. The composite flange assembly of claim 14, wherein the metal reinforcement member comprises at least one sidewall, and wherein the polymeric flange at least partially encapsulates the at least one sidewall.

21. The composite flange assembly of claim 20, wherein the at least one sidewall terminates in a lip, and wherein the polymeric flange encapsulates the lip.

22. The composite flange assembly of claim 14, wherein the metal reinforcement member is joined to the polymeric flange by interference engagement with the polymeric flange.

23. The composite flange assembly of claim 14, wherein the polymeric flange comprises reinforcement ribs extending between opposing sides of the polymeric flange.

24. The composite flange assembly of claim 14, wherein the metal reinforcement member defines at least one hole for accepting a fastener used to secure the flange assembly to the engine component.

25. A method of producing a composite flange assembly for providing sealing engagement with an engine component, comprising:

forming a polymeric flange adapted for association with the engine component; and joining a metal reinforcement member with the polymeric flange to reinforce the polymeric flange, the metal reinforcement member defining at least one opening;

wherein the metal reinforcement member is joined with the polymeric flange, such that at least a portion of the polymeric flange extends through the openings and forms a surface for contacting the engine component.

26. The method of claim 25, wherein the metal reinforcement member is joined to the polymeric flange by injection molding the metal reinforcement member with the polymeric flange.

27. The method of claim 26, wherein the polymeric flange at least partially encapsulates the metal reinforcement member.

28. The method of claim 26, wherein the at least one opening is defined by a perimetrically-extending raised lip on the metal reinforcement member, and wherein the portion of the polymeric flange extending through the at least one opening at least partially encapsulates the raised lip.

29. The method of claim 26, wherein the metal reinforcement member comprises at least one sidewall terminating in a lip, and wherein the polymeric flange at least partially encapsulates the lip.

30. The method of claim 24, further comprising at least partially melting the polymeric flange and joining the metal reinforcement member to the polymeric flange In the at least partially plasticized state of the polymeric flange.

* * * * *